US007513806B2

(12) United States Patent
Noda et al.

(10) Patent No.: US 7,513,806 B2
(45) Date of Patent: Apr. 7, 2009

(54) FEMALE TERMINAL FITTING

(75) Inventors: Masahiro Noda, Yokkaichi (JP); Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/116,266

(22) Filed: May 7, 2008

(65) Prior Publication Data

US 2008/0280507 A1 Nov. 13, 2008

(30) Foreign Application Priority Data

May 8, 2007 (JP) ..... 2007-123114

(51) Int. Cl.
*H01R 11/22* (2006.01)

(52) U.S. Cl. ..... 439/852

(58) Field of Classification Search ..... 439/852, 439/862, 851, 816

See application file for complete search history.

(56) References Cited

U.S. PATENT DOCUMENTS 5,427,553 A 6/1995 Tsuji
6,050,862 A 4/2000 Ishii
6,386,928 B2 * 5/2002 Kitamura ..... 439/852
6,478,636 B1 * 11/2002 Makita et al. ..... 439/852
6,761,597 B2 * 7/2004 Shimizu ..... 439/852
2001/0051472 A1 12/2001 Sato et al.
2004/0224573 A1 11/2004 Yoshida et al.

* cited by examiner

*Primary Examiner*—Neil Abrams
*Assistant Examiner*—Phuong Nguyen
(74) *Attorney, Agent, or Firm*—Gerald E. Hespos; Anthony J. Casella

(57) ABSTRACT

A female terminal fitting (10) is provided with a tubular main portion (30), into which a mating male tab (70) is inserted along an axial center A from the front. A resilient contact piece (80) extends back in the main portion (30) and has a free end slidable on an inner surface of the main portion (30). The inner surface of the main portion (30) includes a first slide surface (51) aligned for permitting displacement of the free end of the resilient contact piece (80) while maintaining a uniform distance to the axial center (A) of the main portion (30) and a second slide surface (52) for permitting displacement of the free end of the resilient contact piece (80) while increasing the distance to the axial center (A) of the main portion (30).

11 Claims, 4 Drawing Sheets

FEMALE TERMINAL FITTING

BACKGROUND OF THE INVENTION

1. Field of the Invention

The invention relates to a female terminal fitting.

2. Description of the Related Art

U.S. Pat. No. 6,050,862 discloses a female terminal fitting with a tubular main portion that can receive a mating male tab inserted from the front and along the axial center of the main portion. A resiliently deformable contact piece extends back in the main portion and has a free end that slides on an inner surface of the main portion. An intermediate portion of the resilient contact piece is held in contact with a male tab inserted into the main portion. An inclined surface is formed on the inner surface of the main portion and enables the free end of the resilient contact piece to be displaced in a direction to extend a distance between the free end and the axial center of the main portion.

The ability of the free end of the resilient contact piece to slide on the inclined surface of the main portion in the above-described terminal fitting avoids a sudden increase of the insertion resistance of the male tab. However, a necessary contact pressure with the male tab is ensured by the sliding-down movement of the free end of the resilient contact piece on the inclined surface. Therefore the insertion stroke of the male tab is extended.

On the other hand, the extension of the insertion stroke of the male tab can be avoided by adopting a construction in which the horizontal inner surface of the main portion receives the free end of the resilient contact piece. However, in this case, the contact pressure suddenly increases due to frictional resistance between the free end of the resilient contact piece and the horizontal surface. Thus, as shown by a line Y in FIG. 4, a displacement width G of the contact portion of the resilient contact piece in a permissible range of the necessary contact pressure becomes smaller, thereby making gap management difficult.

The invention was developed in view of the above situation and an object thereof is to prevent the insertion stroke of a male tab from being extended and to facilitate gap management.

SUMMARY OF THE INVENTION

The invention relates to a female terminal fitting with a substantially tubular main portion that has opposite front and rear ends. The main portion is configured so that a mating male tab can be inserted into the main portion from the front and along an axial center. A resilient contact piece extends back in the main portion and can be deformed as the male tab is inserted into the main portion. This deformation causes the free end of the resilient contact piece to slide on an inner surface of the main portion. The inner surface of the main portion includes first and second slide surfaces. The first slide surface is configured for displacing the free end of the resilient contact piece in a direction to keep a substantially constant distance between the free end and the axial center of the main portion or to shorten the distance while the free end slides from a slide start position to a slide intermediate position. The second slide surface is configured for displacing the free end of the resilient contact piece in a direction to extent the distance between the free end and the axial center of the main portion while the free end slides from the slide intermediate position to a slide end position.

A necessary contact pressure with the male tab is reached early by a sliding movement of the free end of the resilient contact piece on the first slide surface. Thus, the insertion stroke of the male tab is not extended. Further, a large displacement width can be set for the contact portion of the resilient contact piece in a permissible range of the necessary contact pressure by a sliding movement of the free end of the resilient contact piece on the second slide surface. Thus, gap management can be facilitated.

The first and second slide surfaces preferably are formed by embossing a peripheral wall of the main portion to project inwardly. Thus, the necessary contact pressure with the male tab can be adjusted to a desired value according to an embossing depth.

The first slide surface preferably is horizontally continuous at the same height in forward and backward directions and the second slide surface preferably is obliquely continuous at the same angle of inclination with respect to forward and backward directions. Thus, an increase of the contact pressure in the connection process with the male tab can be predicted relatively easily.

A part of the free end of the resilient contact piece behind its contact with the main portion preferably is bent at an obtuse angle towards the axial center so that the free end of the resilient contact piece faces obliquely inwardly toward the back.

The first and second slide surfaces preferably are aligned at an obtuse angle.

The free end of the resilient contact piece preferably contacts the inner surface of the main portion when the resilient contact piece is in a natural state and not in contact with the male tab.

The free end of the resilient contact piece preferably has a partly spherical projection projecting towards the main portion and held in sliding point contact with the inner surface of the main portion.

The male tab preferably can be sandwiched resiliently between the contact of the resilient contact piece and a receiving portion of the main portion.

The first and second slide surfaces preferably are on the inner surface of an elevated portion formed by inwardly embossing a facing plate of the main portion. The necessary contact pressure with the male tab can be adjusted to a desired value according to an embossing depth.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
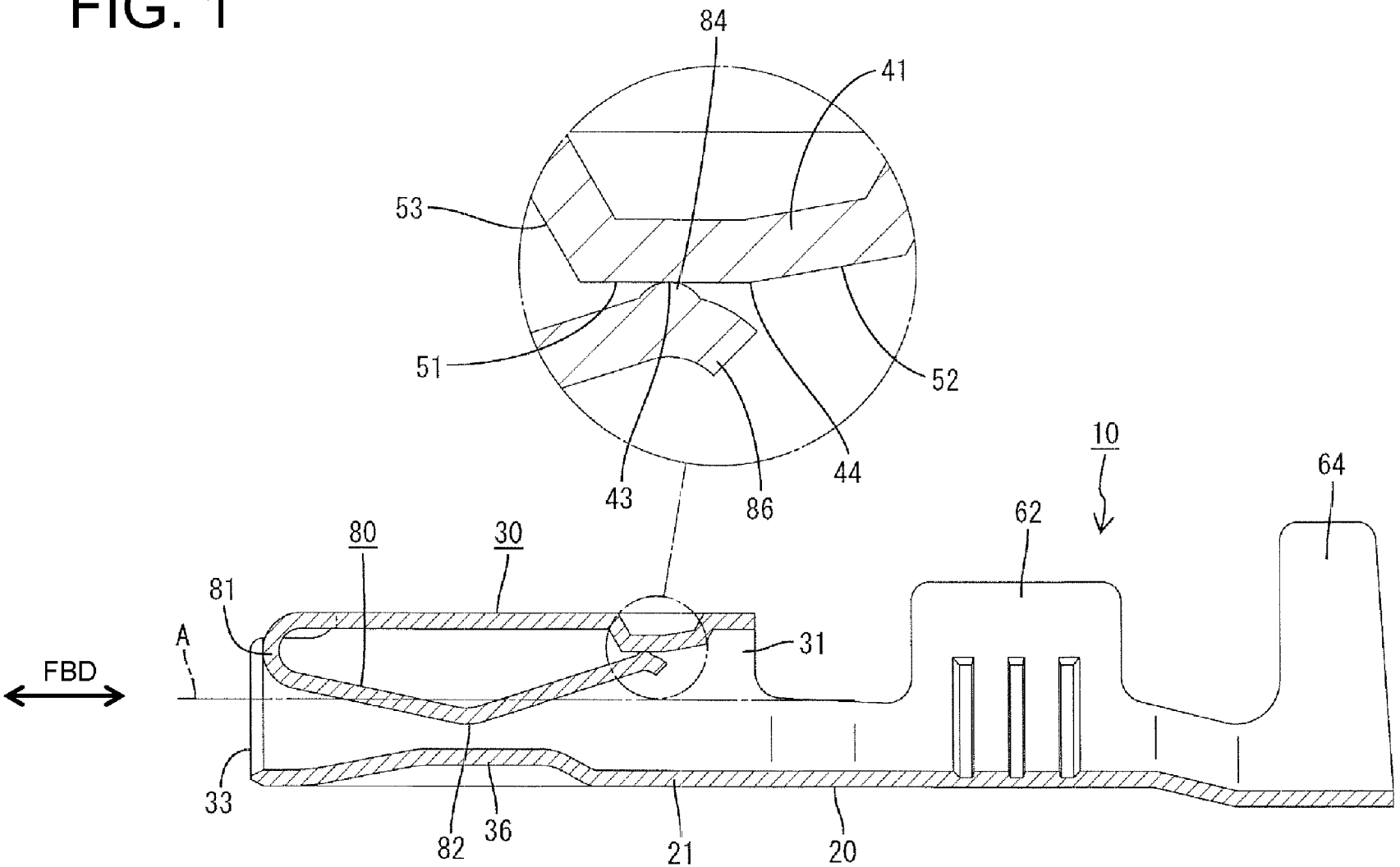
FIG. 1 is a side view in section of a female terminal fitting according to one embodiment.

A female terminal fitting in accordance with the invention is identified by the numeral 10 in FIGS. 1 to 4 and is formed by bending, folding and/or embossing a unitary electrically conductive metal plate. The female terminal fitting 10 has a base plate 20 that is long and narrow and long in forward and backward directions FBD. A main portion 30 is at a front part 21 of the base plate 20, a wire connection portion 60 is at a rear part of the base plate 20, and a resilient contact piece 80 extends back in the main portion 30.

The wire connection portion 60 includes a wire barrel 62 with left and right front crimping pieces 61 to be crimped, bent or folded into connection with the conductive core at an end of an unillustrated wire and an insulation barrel 64 with left and right rear crimping pieces 63 to be crimped, bent or folded into connection with the insulation coating at the end of the wire or with a resilient plug mounted on the insulation coating. The wire barrel 62 is located before the insulation barrel 64.

The main portion 30 is a substantially rectangular tube that is open both forward and backward. More particularly, the main portion 30 includes a front part 21 of the base plate 20, two side plates 31 that project up at substantially right angles from the opposite widthwise sides (or near thereto) of the front part 21 of the base plate 20, and a facing plate 32 extending substantially perpendicularly between the upper ends of the side plates 31 and substantially facing the front part 21 of the base plate 20. An insertion opening 33 is defined at the front end of the main portion for receiving a mating male tab 70 from the front and substantially along an axial center A.

As shown in FIG. 1, the resilient contact piece 80 is bent back from the front end of the facing plate 32 to define a mountain-shape for contacting the male tab 70. Slits 35 are formed in front ends of the side plates 31 and the facing plate 32. The slits 35 enable a front end of the resilient contact piece 80 to be formed into a substantially semicircular curve 81 located slightly behind the front ends of the base plate 20 and the opposite side plates 31 in forward and backward directions FBD.

A contact 82 is defined at the bent apex of the mountain-shaped resilient contact piece 80, and the male tab 70 and a receiving portion 36 is embossed to project inwardly on the base plate 20 at a position opposed to the contact. The receiving portion 36 is a substantially trapezoidal rib that is long and narrow in forward and backward directions FBD and has a substantially flat straight surface extending substantially parallel to an inserting direction ID (forward and backward directions FBD). A distance between the contact 82 and the receiving portion 36 is slightly less than the thickness of the male tab 70 when the resilient contact piece 80 is in a natural state. Thus, the male tab 70 can be sandwiched resiliently between the contact 82 and the receiving portion 36.

The free rear end of the resilient contact piece 80 contacts the inner surface of the facing plate 32 in the natural condition of the resilient contact piece 80. A partly spherical projection 84 is formed at the free end of the resilient contact piece 80 and projects towards the facing plate portion 32. The spherical projection 84 can be held in sliding point contact with the inner surface of the facing plate 32. A bent portion 86 is formed adjacent the free end of the resilient contact piece 80, and hence behind the spherical projection 84. The bent portion 86 is bent at an obtuse angle towards the axial center A, so that the free end of the resilient contact piece 80 faces obliquely in towards the back.

A substantially rectangular widthwise middle part of the facing plate 32 is embossed to form an inward projection 41 (see FIG. 3) with inwardly facing first and second slide surfaces 51, 52 and first and second elevating surfaces 53 and 54. The surfaces 51, 52, 53 and 54 are closer to the axial center A than all other parts of the inner surface of the facing plate 32, and the spherical projection 84 slides along the slide surfaces 51 and 52 when the male tab 70 deforms the resilient contact piece 80. More specifically, the first slide surface 51 extends from a slide start position 43 where the spherical projection 84 of the resilient contact piece 80 starts sliding to a slide intermediate position 44. The second slide surface 52 extends from the slide intermediate position 44 at the rear end of the first slide surface 51 to a slide end position 45 where the spherical projection 84 of the resilient contact piece 80 stops sliding. The first elevating surface 53 connects the unembossed parts of the inner surface of the facing plate 32 and the starting end of the first slide surface 51 and the second elevating surface 54 connects the unembossed parts of the inner surface of the facing plate portion 32 and the termination end of the second slide surface 52.

The first and second elevating surfaces 53, 54 are substantially straight and are inclined at the substantially same angle to approach each other as they extend inwardly. The first elevating surface 53 is longer than the second elevating surface 54, and the termination end of the first elevating surface 53 is closer to the axial center A than the starting end of the second elevating surface 54. The first and second elevating surfaces 53, 54 do not contact the resilient contact piece 80 and do not directly involve the sliding movement of the spherical projection 84 of the resilient contact piece 80.

The first slide surface 51 is substantially is straight and parallel to the inserting direction ID and to the forward and backward directions FBD at a substantially constant distance from the axial center A from the termination end of the first elevating surface 53 to the starting end of the second slide surface 52. The second slide surface 52 inclines moderately out with respect to the inserting direction ID and the forward and backward directions FBD to be gradually more distanced from the axial center A from the termination end of the first slide surface 51) to the starting end of the second elevating surface 54. The slide start position 43 is in the center of the first slide surface 51 in forward and backward directions FBD, the slide intermediate position 44 is set at the starting end of the second slide surface 52, and the slide end position 45 is at a position of the second slide surface 52 slightly closer to the first slide surface 51 than the center in forward and backward directions FBD.

As shown in FIG. 1, the spherical projection 84 at the free end of the resilient contact piece 80 contacts the first slide surface 51 of the main portion 30 at the slide start position 43 before the connection with the mating male tab 70 is started. Thus, the resilient contact piece 80 is supported at both ends. Connection with the male tab 70 is started by connecting unillustrated male and female connectors, and the mating male tab 70 is inserted into the main portion 30 of the female terminal fitting 10 through the insertion opening 33 at the front.

The resilient contact piece 80 is deformed resiliently by the pressing force generated when the leading end of the male tab 70 engages the contact 82 of the resilient contact piece 80, and the spherical projection 84 at the free end of the resilient contact piece 80 starts moving back along the first slide surface 51 from the slide start position 43. The spherical projection 84 of the resilient contact piece 80 is displaced horizontally with its distance to the axial center A kept substantially constant while sliding along the first slide surface 51 from the slide start position 43 to the slide intermediate position 44.

Figure 2:
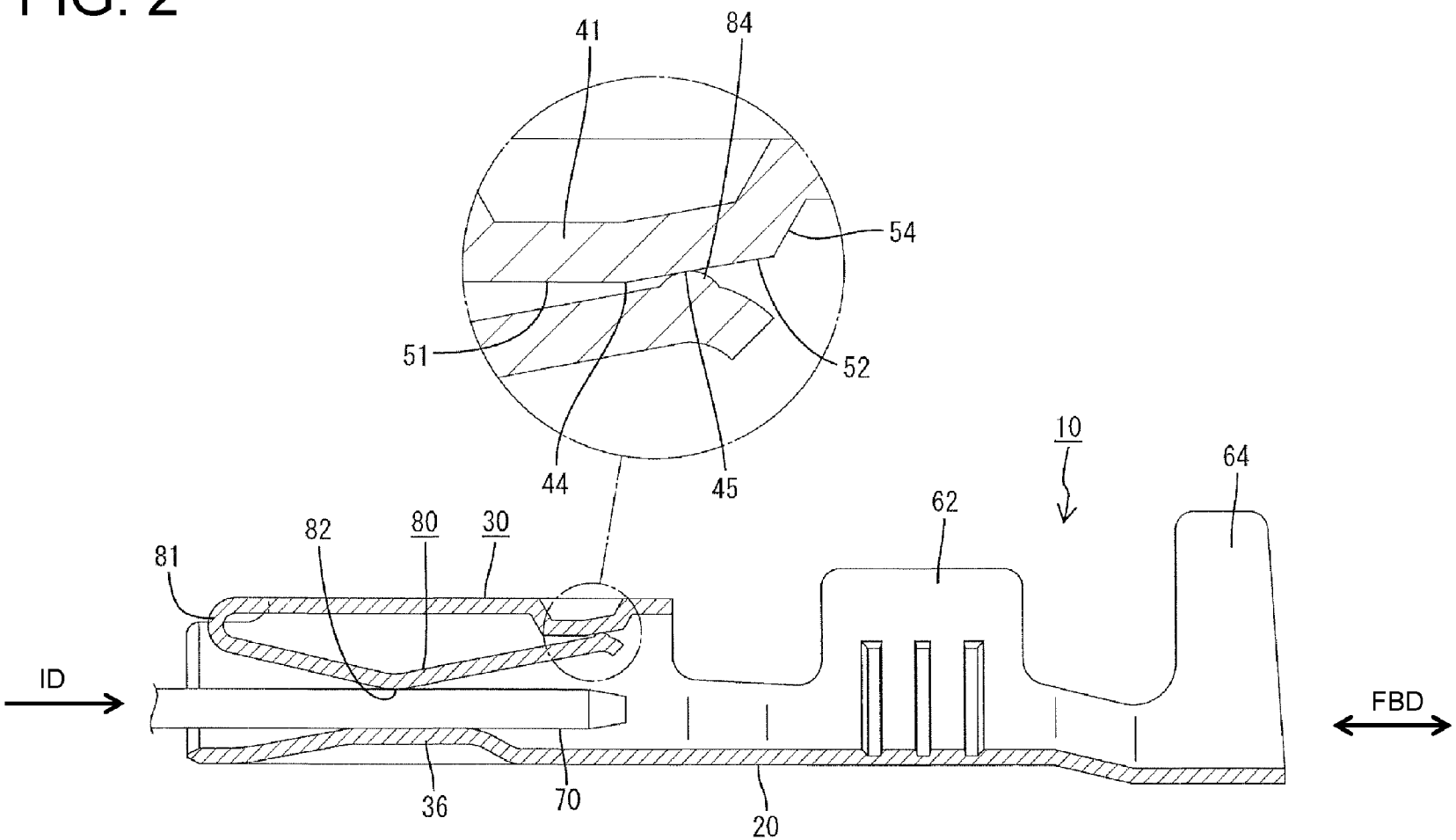
FIG. 2 is a side view in section of the female terminal fitting when a male tab is properly inserted into a main portion.
Figure 3:
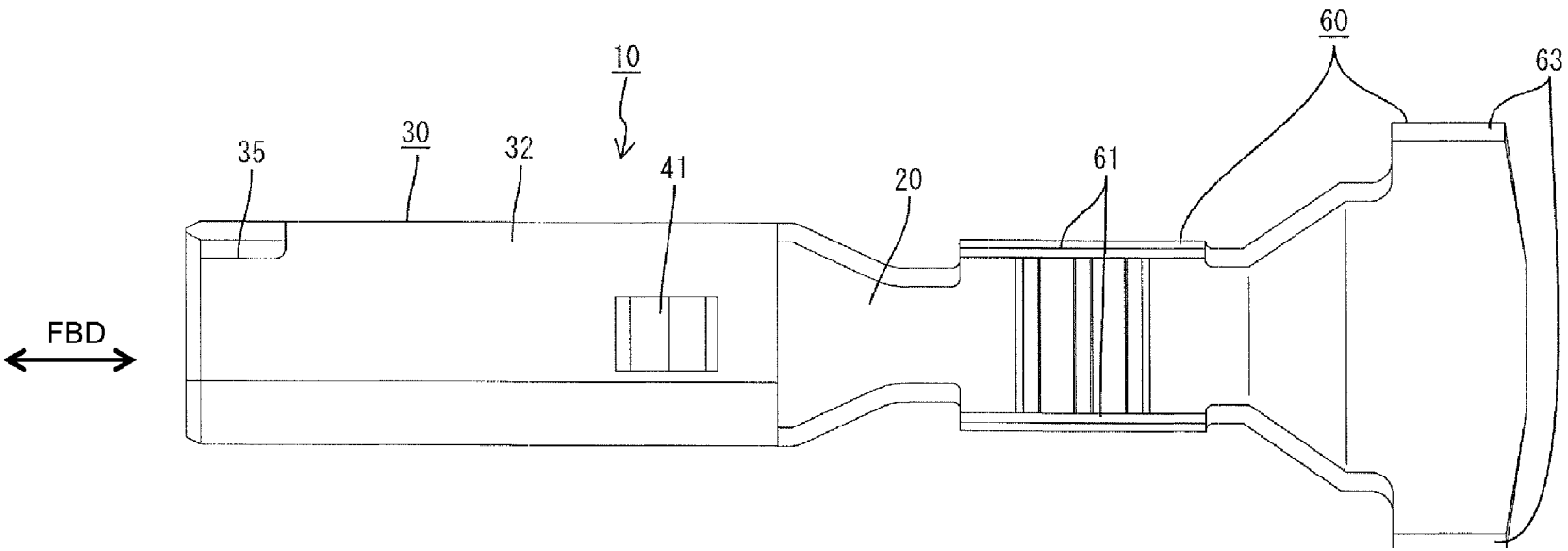
FIG. 3 is a plan view of the female terminal fitting.

The spherical projection 84 moves from the first slide surface 51 to the second slide surface 52 as the resilient contact piece 80 moves farther into the main portion 30. Additionally, the spherical projection 84 of the resilient contact piece 80 is displaced in a direction to be farther from the axial center A while sliding along the second slide surface 52 from the slide intermediate position 44 to the slide end position 45, and then slides down toward the termination end of the second slide surface 52. The spherical projection 84 of the resilient contact piece 80 is supported in contact with the inclined second slide surface 52 at the slide end position 45, as shown in FIG. 2, when movement of the resilient contact piece 80 into the main portion 30 is completed. Thus, a suitable and necessary contact pressure is given between the contact 82 of the resilient contact piece 80 and the male tab 70.

Figure 4:
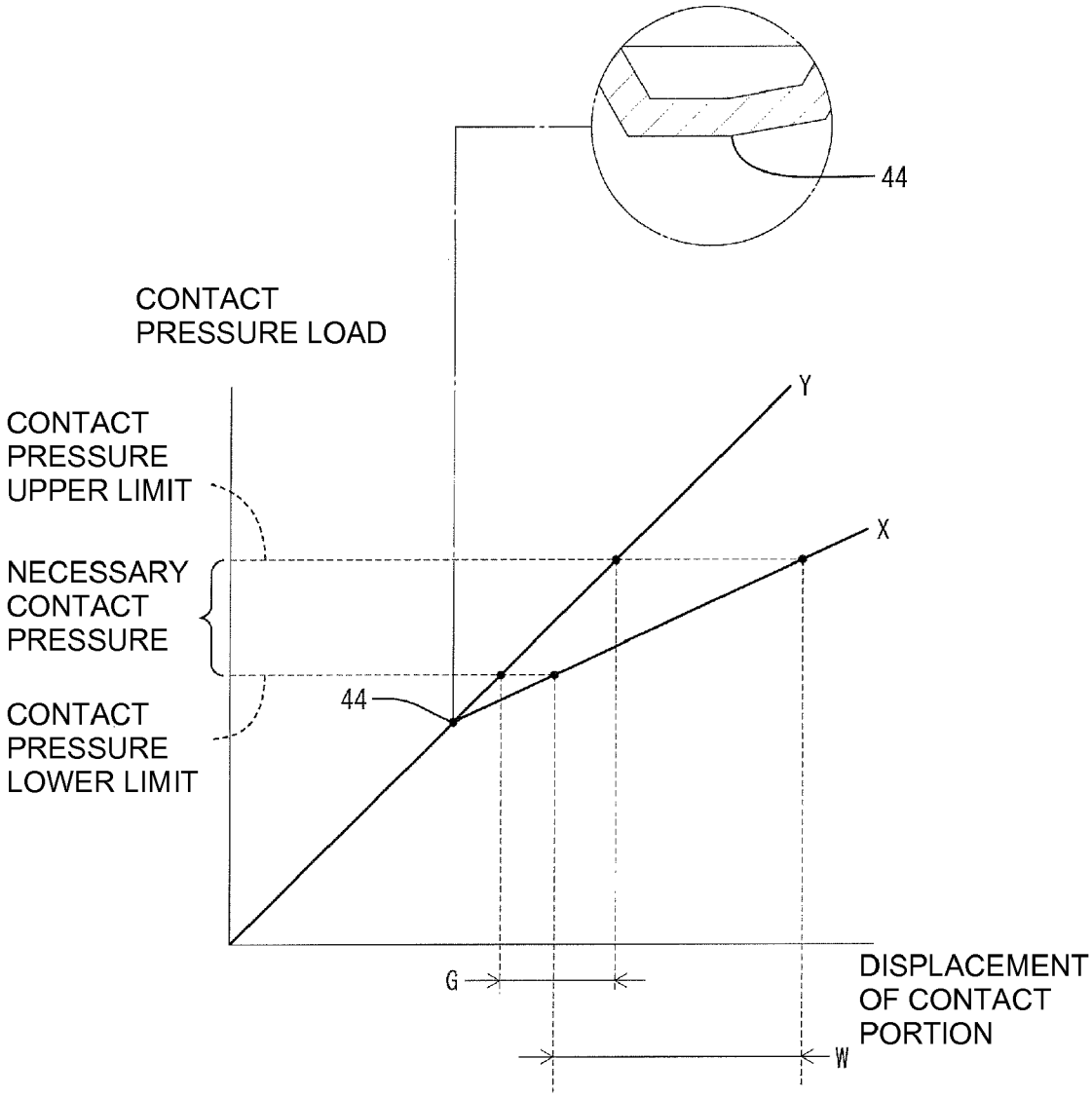
FIG. 4 is a line graph showing a change of a contact pressure load.

A contact pressure load with the male tab 70 gradually increases as the spherical projection 84 of the resilient contact piece 80 slides on the first and second slide surfaces 51, 52. FIG. 4 is a graph in which the vertical axis represents the contact pressure load with the male tab 70 and the horizontal axis represents an amount of displacement of the contact 82 orthogonal to the inserting direction ID of the male tab 70. Line X in FIG. 4 is an example of this embodiment and line Y shows a comparative example in which the free end of the resilient contact piece 80 slides on a horizontal surface during the entire connecting operation. The bend of the line X corresponds to the slide intermediate position 44 at which the spherical projection 84 of the resilient contact piece 80 transfers from the first slide surface 51 to the second slide surface 52.

The contact pressure load increases in proportion to an increase in the amount of displacement of the contact portion 82 while spherical projection 84 of the resilient contact piece 80 slides on the first slide surface 51, and reaches the vicinity of the necessary contact pressure when the spherical projection 84 of the resilient contact piece 80 reaches the slide intermediate position 44.

Thereafter, the contact pressure load increases in proportion to the increase in the amount of displacement of the contact 82 while the spherical projection 84 of the resilient contact piece 80 slides on the second slide surface 52, but its increasing rate (or derivative) becomes smaller. Thus, the amount of displacement of the contact 82 until the contact pressure load reaches the necessary contact pressure from the slide intermediate position 44 is smaller in the comparative example. Therefore the necessary contact pressure is reached earlier in the comparative example than in this embodiment. However, a difference is small since the contact pressure load already reaches the vicinity of the necessary contact pressure at the slide intermediate position 44 in this embodiment. A permissible range between contact pressure upper and lower limits in the management of the necessary contact pressure is set, and the contact pressure load gradually increases in proportion to the amount of displacement of the contact portion 82 in this permissible range.

According to this embodiment, as is clear from FIG. 4, the necessary contact pressure with the male tab 70 can be reached early by the sliding movement of the spherical projection 84 of the resilient contact piece 80 on the first slide surface 51 of the main portion 30. Therefore, the insertion stroke of the male tab 70 is not extended more than necessary, thereby improving operability.

A displacement distance W of the contact 82 in the permissible range of the necessary contact pressure is about twice as large as the displacement distance G of the contact 82 in the comparative example because the spherical projection 84 of the resilient contact piece 80 slides along the inclined surface of the slide surface 53. Therefore, a large value can be set for gap management during manufacturing to facilitate the gap management.

If the resilient contact piece 80 is set permanently in fatigue due to repeated use or the like (i.e. the spring property of the resilient contact piece 80 decreases), the contact pressure load decreases according to the displacement distance when the position of the contact 82 of the resilient contact piece 80 is displaced. However, in this embodiment, a drop in the contact pressure load with respect to the displacement distance is suppressed as compared to the comparative example, and performance is improved.

The first and second slide surfaces 51, 52 are arranged on the inner surface of the projection 41 formed by inwardly embossing the facing plate 32 of the main portion 30. Thus, the necessary contact pressure with the male tab 70 can be adjusted to a desired value according to an embossing depth.

The first slide surface 51 is continuous at the same height in forward and backward directions FBD and the second slide surface 52 is obliquely continuous at the same angle of inclination with respect to forward and backward directions FBD. Thus, the increasing tendency of the contact pressure in the connection process with the male tab 70 can be predicted easily from a proportional relationship. Furthermore, the sliding movement is started smoothly started since the spherical projection 84 of the resilient contact piece 80 is in contact with the first slide surface 51 of the main portion 30 at the slide start position 43 when the male tab 70 is not inserted.

The invention is not limited to the above described and illustrated embodiment. For example, the following embodiments are also embraced by the technical scope of the present invention as defined by the claims.

The first slide surface may be formed to have an inclination opposite to that of the second slide surface so that the free end of the resilient contact piece is displaced in a direction to shorten the distance between this free end and the axial center from the slide start position to the slide intermediate position. Thus, the necessary contact pressure can be reached even earlier.

The free end of the resilient contact piece and the inner surface of the main portion may not be in contact when the male tab is not inserted.

The second slide surface may be a curved inclined surface.

The inner surfaces of the projection may include only the first and second slide surfaces without including the first and second elevating surfaces.

The resilient contact piece may be provided at the base plate and the receiving portion may be provided at the facing plate.

The free end of the resilient contact piece may have no spherical projection, and the curved surface of the bent portion may slide in contact with the first and second slide surfaces.

What is claimed is:

1. A female terminal fitting, comprising:

a substantially tubular main portion with a rear end and an open front end for receiving a mating male tab along an axial center;

a resilient contact piece extending back in the main portion and being deformable by insertion of the male tab into the main portion, the resilient contact piece having a free end that slides on an inner surface of the main portion;

a first slide surface extending along the inner surface of the main portion from a slide start position to a slide intermediate position for permitting sliding displacement of the free end of the resilient contact piece while keeping a distance between the free end and the axial center of the main portion substantially constant or shortening the distance; and a second slide surface extending from the slide intermediate position to a slide end position for permitting sliding displacement of the free end of the resilient contact piece while extending the distance between the free end and the axial center of the main portion, wherein the first and second slide surfaces are formed by inwardly embossing a peripheral wall of the main portion, and wherein the resilient contact piece includes a projection projecting toward and slidably engaging at least one of the first and second slide surfaces.

2. The female terminal fitting of claim 1, wherein the first slide surface is substantially parallel to the axial center and the second slide surface is oblique to the axial center at substantially constant angle of inclination.

3. The female terminal fitting of claim 1, wherein the first slide surface and the second slide surface are arranged to define an obtuse angle therebetween.

4. The female terminal fitting of claim 1, wherein the free end of the resilient contact piece is in contact with the inner surface of a plate of the main portion when the resilient contact piece is in a natural state and not in contact with the male tab.

5. The female terminal fitting of claim 1, wherein the projection is partly spherical and is held in sliding point contact with the inner surface of the main portion.

6. The female terminal fitting of claim 1, wherein the free end of the resilient contact piece includes a bent portion bent at an obtuse angle towards the axial center so that the free end of the resilient contact piece faces obliquely inwardly toward the back.

7. The female terminal fitting of claim 1, wherein the male tab can be sandwiched resiliently between a contact of the resilient contact piece and a receiving surface of the main portion.

8. The female terminal fitting of claim 1, wherein the first and second slide surfaces are arranged on an inwardly embossed projection on a facing plate of the main portion so that contact pressure with the male tab can be adjusted according to an embossing depth.

9. A female terminal fitting, comprising:

a substantially tubular main portion with a rear end, an open front end and an axial center extending between the ends;

an inwardly embossed projection on a peripheral wall of the main portion, the projection having inwardly facing first and second slide surfaces, the first slide surface extending substantially parallel to the axial center, the second slide surface being aligned oblique to the axial center so that a distance from the second slide surface to the axial center is greater at positions closer to the rear end; and a resiliently deformable contact piece extending back in the main portion and having a free end slidably engaged with the projection, whereby a male tab inserted into the open front end of the tubular main portion resiliently deforms the contact piece and causes the free end of the contact piece to slide rearwardly from the first slide surface to the second slide surface, wherein the resilient deformable contact piece includes a mountain shaped contact pointing towards a wall of the tubular main portion opposite the wall that has the projection; and wherein a rounded projections projects toward the main portion at the free end of the resilient contact piece and achieves sliding point contact with the first and second slide surfaces.

10. The female terminal fitting of claim 9, wherein the free end of the resilient contact piece includes a bent portion bent at an obtuse angle rearward of the rounded projection to extend towards the axial center.

11. The female terminal fitting of claim 10, wherein the first slide surface and the second slide surface meet at an obtuse angle.

* * * * *